United States Patent [19]

Prenn

[11] Patent Number: 4,838,062

[45] Date of Patent: Jun. 13, 1989

[54] PROCESS FOR UPSET FORGING OF LONG STANDS OF METAL BAR STOCK

[75] Inventor: Otto E. Prenn, Sherwood Park, Canada

[73] Assignee: Stelco Inc., Hamilton, Canada

[21] Appl. No.: 133,340

[22] Filed: Dec. 15, 1987

[30] Foreign Application Priority Data

Dec. 18, 1986 [CA] Canada ..... 525761

[51] Int. Cl.[4] ..... B21J 3/00; B21J 5/08

[52] U.S. Cl. ..... 72/41; 72/318; 72/342; 72/356; 72/357

[58] Field of Search ..... 72/318, 364, 342, 356, 72/357, 354, 41, 45; 10/27 H

[56] References Cited

U.S. PATENT DOCUMENTS

| | | | |
|---|---|---|---|
| 245,691 | 8/1981 | Alker . | |
| 1,041,999 | 10/1912 | Hansen | 72/364 |
| 1,416,635 | 5/1922 | Halleck | 72/318 |
| 2,142,239 | 1/1939 | Cook | 76/108 |
| 2,442,142 | 5/1948 | Nettenstrom | 78/61 |
| 2,507,817 | 5/1950 | Ropp et al. | 10/59 |
| 2,581,774 | 1/1952 | Stone et al. | 72/364 |
| 3,381,513 | 5/1968 | Jouannet | 72/324 |
| 3,396,567 | 8/1968 | Bachmann | 72/318 |
| 4,100,781 | 7/1978 | Zawacki et al. | 72/41 |
| 4,317,355 | 3/1982 | Hatsumo et al. | 72/364 |
| 4,405,565 | 9/1983 | Herbort et al. | 422/197 |

FOREIGN PATENT DOCUMENTS

| | | | |
|---|---|---|---|
| 25837 | 2/1983 | Japan | 72/342 |

OTHER PUBLICATIONS

"Forgings Requiring a Long Stand of Metal", The Forger, Article No. 17, distributed by The Hill Acme Company of Cleveland, Ohio.

"Fundamental Principles Governing Upset Forging", The Forger, Article No. 22, distributed by the Hill Acme Company of Cleveland, Ohio.

"Forging Principle No. 2", The Forger, Article No. 23, distributed by the Hill Acme Company of Cleveland, Ohio.

"Forging Principle No. 3", The Forger, Article No. 24, distributed by The Hill Acme Company of Cleveland, Ohio.

*Primary Examiner*—Daniel C. Crane

*Attorney, Agent, or Firm*—Fleit, Jacobson, Cohn, Price, Holman & Stern

[57] ABSTRACT

Process and apparatus for upset forging a long stand of solid malleable metal bar stock in a single pass is capable of gathering a large volume of the bar stock into a complex shaped element. The end of the bar stock is selectively heated to provide an intermediate section thereof to a desired upper forging temperature and an end section thereof at a desired lower forging temperature. The heated bar stock is positioned in an upset forging die cavity. A forging punch enters the cavity to upset the long stand to fill the cavity firstly with the upset intermediate section and then the remainder of the cavity with the end section which is at a lower forging temperature. A friction reducing material is provided in the cavity to provide for sliding of the end section along the cavity while the end seciton upsets and gathers the intermediate section of the bar in the major portion of the upset cavity section.

20 Claims, 6 Drawing Sheets

FIG. 11.
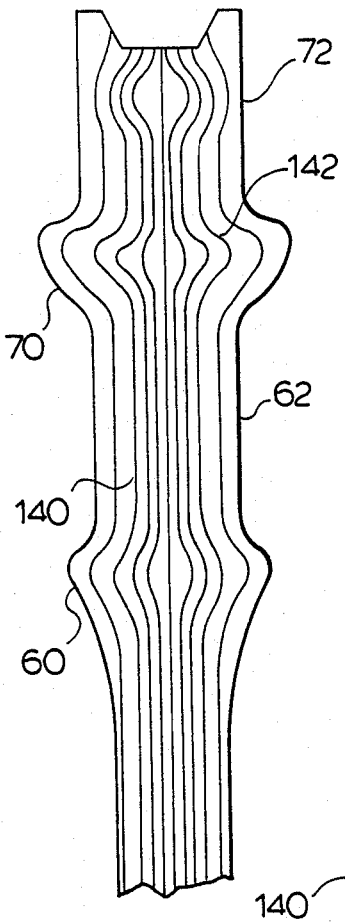
FIG. 12. PRIOR ART.
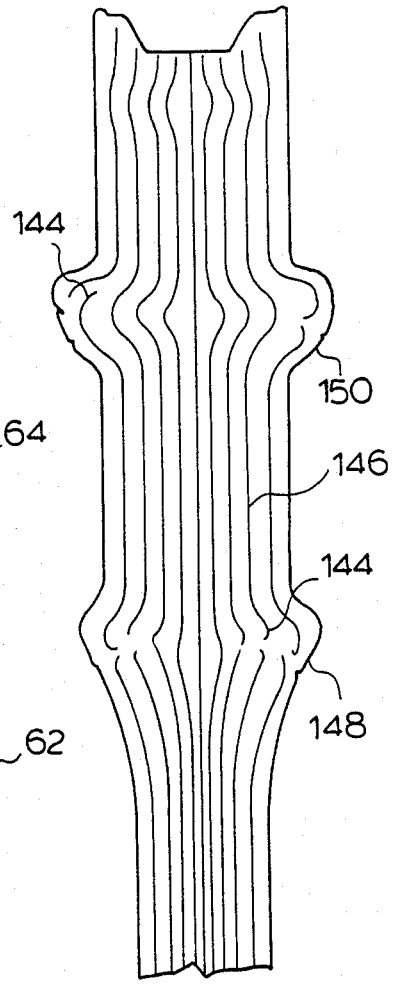
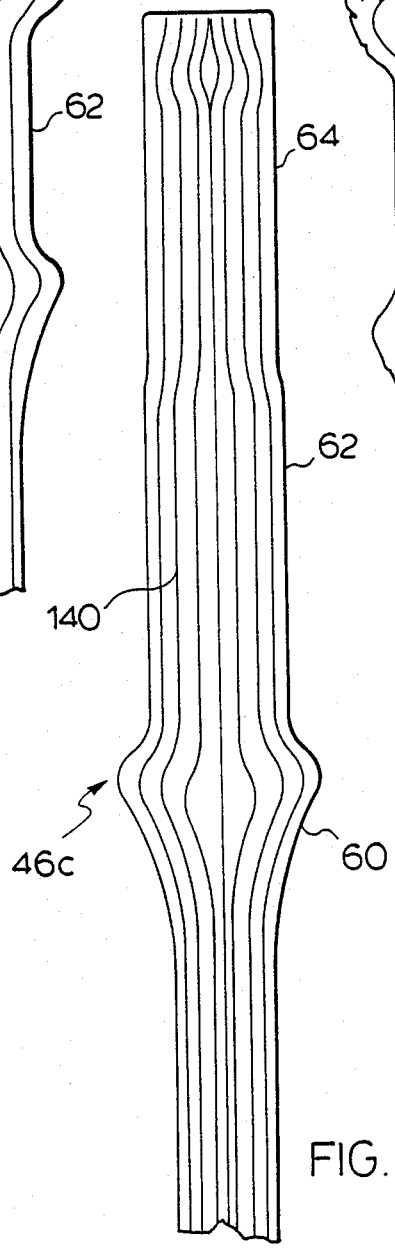
FIG. 10.

PROCESS FOR UPSET FORGING OF LONG STANDS OF METAL BAR STOCK

FIELD OF THE INVENTION

This invention relates to upset forging of solid malleable metal bar stock and more particularly to upset forging of long stands of such bar stock to gather a large volume of the bar stock into a complex shaped element in a single pass.

BACKGROUND OF THE INVENTION

Metal bar is commonly forged to form various shapes on the end of the bar or somewhere along the bar length to provide one type or another of mechanical function for the produced shaped. For example, bolt heads are commonly forged on end of bolts and the like. Collars or cylindrical rings are also commonly forged in rod sections for purposes of coupling. It is also very common to forge the end connection on a sucker rod which is used in pumping oil from oil wells. The rod end connection must meet particular specifications according to the American Petroleum Institute which are exacting in their limits. Various types of heading dies are used to forge the end connection on the sucker rod. One example is the sliding type of die and another type is a cone-shaped heading die. In developing the end connection for the sucker rod, a large volume of metal is upset forged. Hence it is commonly understood that a long stand of metal bar must be upset to produce the end connection. The end connection consists of a back shoulder, a wrench flat, a front shoulder and a threaded cylindrical end.

There are several operations required to forge the end connection. In using a cone-shaped heading tool, there are usually six steps in forming the sucker rod end connection to achieve the exacting specification limits. An example of this type of forging operation in producing end connections in sucker rods is disclosed in the article "The Forger" distributed by The Hill Acme Company of Cleveland, Ohio. This article exemplifies the type of cone-shaped cavities used in heading tools to provide for a significant upset of the long stand of metal stock in forming the sucker rod end connection.

Other than in the field of forging sucker rod ends, heading machines, which have been used to upset rod ends to form special shapes, have been available for some time, such as exemplified in U.S. Pat. No. 4,405,565. A punch enters a die cavity to upset forge the rod end in forming an enlarged cylindrical portion.

In an earlier U.S. Pat. No. 245,691, the end of a rod is upset to form a flange thereon with an enlarged cylindrical end by use of a cavity die which is rammed against the end of the held rod. More recently, heading dies have been used to form bolt heads and the like, such as disclosed in U.S. Pat. Nos. 3,381,513 and 2,142,239.

As mentioned, sliding dies may be used when it is desired to upset forge a long stand of material, such as disclosed in U.S. Pat. No. 2,442,142. In that patent, an enlarged portion with an annular ring is formed intermediate the length of the rod by upset forging using a die which slides along with the punch in forming the annular ring. However, sliding dies are limited in terms of the complexity of shape that may be formed along the rod.

U.S. Pat. No. 3,396,567 is directed to a heading tool for upsetting the end of a rod to develop various desired shapes. One of the problems this patent sets out to overcome is avoiding the many problems associated with a non-uniform heating of the end of the rod to be upset forged. The patent discloses a type of heating using an induction heating coil or resistive heating electrode to develop a uniformly heated end section of the rod which significantly enhances the development by upset forging of the end shape.

SUMMARY OF THE INVENTION

According to an aspect of this invention, a process for upset forging a long stand of solid malleable metal bar stock in a single pass to gather a large volume of the bar stock into a complex shaped element comprises:

(1) selectively applying heat to the long stand of bar stock by heating an intermediate section thereof to desired upper forging temperature and heating an end section thereof to desired lower forging temperature;

(2) positioning the selectively heated long stand of bar stock in an upset forging die cavity comprising opposing mating die blocks within which the cavity is defined, the cavity having:

(a) a bar supporting section which intimately contacts the bar stock inwardly of the heated intermediate section;

(b) a major upsetting section surrounding a major length of the heated intermediate section, and (c) a secondary upsetting section surrounding a remaining minor length of the intermediate section and the end section, the secondary upsetting section receiving and guiding a forging punch;

(3) the secondary upsetting section being provided with means for reducing friction on cavity walls thereof;

(4) gripping the bar stock inwardly of the intermediate section to hold the gripped bar stock stationary relative to the die blocks in preparation for upset forging of the intermediate and the end sections of the bar stock;

(5) punching with the forging punch in a single blow the end section to upset the intermediate section to fill the major upsetting section of the cavity, the lower forging temperature of the end section being such that a controlled upset of the end section in the secondary upsetting cavity section having the friction reducing material provides for sliding of the end section along the secondary upsetting cavity section while the end section upsets and gathers the intermediate section in the major upsetting cavity section;

(6) continuing travel of the single punch blow to complete filling the secondary upsetting cavity section with the end portion.

According to another aspect of the invention, a process is provided for upset forging a long stand of steel bar stock in two passes into an end connection for a sucker rod. The end connection consists of a back shoulder, a wrench flat, a front shoulder and a cylindrical tip which is subsequently threaded. The process comprises for the first pass:

(1) selectively applying heat to the long stand of bar stock by heating an intermediate section thereof to desired upper forging temperature and heating an end section thereof to desired lower forging temperature;

(2) positioning the selectively heated long stand of bar stock in an upset forging first die cavity comprising opposing mating die blocks within which the first cavity is defined, the first cavity having:

(a) a bar supporting section which intimately contacts the bar stock inwardly of the heated intermediate section;

(b) a major upsetting section surrounding a major length of the heated intermediate section, and (c) a secondary upsetting section surrounding a remaining minor length of the intermediate section and the end section, said major upsetting section defining the back shoulder and the wrench flat portions of the end connection and the secondary upsetting section defining an enlarged cylindrical portion which is forged into the front shoulder and cylindrical tip in the second pass, the secondary upsetting section receiving and guiding a forging punch;

(3) the secondary upsetting section being provided with means for reducing friction on cavity walls thereof;

(4) gripping the bar stock inwardly of the intermediate section to hold the gripped bar stock stationary relative to the die blocks in preparation for upset forging of the intermediate and the end sections of the bar stock;

(5) punching with the forging punch in a single pass the end section to upset the intermediate section to fill the major upsetting section of the cavity, the lower forging temperature of the end section being such that a controlled upset of the end section in the secondary upsetting cavity section having the friction reducing material provides for sliding of the end section along the secondary upsetting cavity section while the end section upsets and gathers the intermediate section in the major upsetting cavity section;

(6) continuing travel of the single punch blow to complete filling the secondary upsetting cavity section with the end portion;

(7) removing the long stand of steel bar as forged from the first die cavity and positioning the forged steel bar in an upset forging second die cavity comprising opposing mating die blocks within which the second cavity is defined, the second cavity having:

(a) a bar supporting section which intimately contacts the bar stock inwardly of the back shoulder;

(b) a back shoulder and wrench flat supporting section which receives and supports the back shoulder and a portion of the wrench flat;

(c) a major upsetting section surrounding a remaining portion of the wrench flat and a transition portion of the long stand from the wrench flat into the cylindrical portion and a portion of the cylindrical portion;

(d) a secondary upsetting section surrounding a remaining portion of the cylindrical portion;

the major upsetting section of the second cavity defining the front shoulder and the secondary upsetting section defining the cylindrical tip, the secondary upsetting section of the second cavity receiving and guiding a second forging punch;

(8) gripping the bar stock inwardly of the back shoulder to hold the gripped bar stock stationary relative to the die blocks defining the second cavity;

(9) punching with the second forging punch in a second pass the cylindrical portion to upset at least the transition zone and a portion of the cylindrical portion to fill the major upsetting section of the second cavity to upset forge the front shoulder and upsetting a remaining portion of the cylindrical portion to fill the secondary upsetting section of the second cavity to upset forge the cylindrical tip.

According to another aspect of the invention, apparatus is provided for upset forging of a long stand of solid malleable metal bar stock in a single pass to gather a large volume of a long stand of bar stock into a complex shaped element. The apparatus comprises:

(1) a support frame;

(2) opposing mating die blocks mounted on the support frame, means for moving the die blocks into and out of mating engagement to define open and closed positions, the die blocks in the closed position defining a die cavity within which a long stand of metal bar is upset forged;

(3) the die cavity comprising:

(a) a bar supporting section which intimately contacts the bar stock inwardly of the long stand;

(b) a major upsetting section surrounding a major length of the long stand, and a secondary upsetting section surrounding a minor length of the long stand; and (c) a secondary upsetting section surrounding a minor length of the long stand;

(4) a forging punch mounted on the frame, means for reciprocating the punch along a first axis which is aligned with the secondary upsetting section whereby the reciprocating means moves the forging punch along the secondary cavity;

(5) means for gripping the bar stock and holding it stationary relative to the die blocks;

(6) means for reducing friction being provided on cavity walls defining the secondary upsetting section;

(7) the major upsetting section and the secondary upsetting section of the cavity having a volume sufficient to accommodate upset of all of the long stand of bar stock in the cavity by a single pass of the forging punch along the secondary cavity, the long stand of bar stock having a length to nominal cross-sectional width ratio of at least 8, the friction reducing material permitting the forging punch to move the long stand of bar stock along the secondary upsetting section while the long stand of bar stock is being upset in the major and secondary upsetting sections of the cavity.

According to another aspect of the invention, apparatus is provided for upset forging of a long stand of solid malleable metal bar stock in two passes into an end connection for a sucker rod. The end connection consists of a back shoulder, a wrench flat, a front shoulder and a cylindrical tip which is subsequently threaded. The apparatus comprises:

(1) a support frame;

(2) opposing mating die blocks mounted on the support frame, means for moving the die blocks into and out of mating engagement to define open and closed positions, the die blocks in the closed position defining a die cavity within which a long stand of metal bar is upset forged, the die blocks defining first and second die cavities within which a long stand of steel bar is upset forged in a first pass in the first cavity and then in a second pass in the second cavity;

(3) the first die cavity comprising:

(a) a bar supporting section which intimately contacts the bar stock inwardly of the long stand;

(b) a major upsetting section surrounding a major length of the long stand, and (c) a secondary upsetting section surrounding a minor length of the long stand;

the major upsetting section defining the back shoulder and the wrench flat portions of the end connection, the secondary upsetting section defining an enlarged cylindrical portion which is forged into the front shoulder and cylindrical tip in the second pass;

(4) the second die cavity comprising:

(a) a bar supporting section which intimately contacts the bar stock inwardly of the back shoulder;

(b) a back shoulder and wrench flat supporting section which receives and supports the back shoulder and a portion of the wrench flat;

(c) a major upsetting section surrounding a remaining portion of the wrench flat and a transition portion of the long stand from the wrench flat into the cylindrical portion and a portion of the cylindrical portion;

(d) a secondary upsetting section surrounding a remaining portion of the cylindrical portion;

the major upsetting section of the second cavity defining the front shoulder and the secondary upsetting section defining the cylindrical tip;

(5) a ram having first and second forging punches being mounted on the frame, means for reciprocating the ram to move the first and second punches along first and second axes, the secondary upsetting section of the first and second cavities being aligned with the first and second punch axes, whereby the reciprocating means moves the first and second forging punches along the corresponding secondary upsetting sections of the first and second cavities;

(6) means associated with each of the first and second cavities for gripping the bar stock and holding it stationary relative to the die blocks;

(7) means for reducing friction being provided on cavity walls defining the secondary upsetting section in the first cavity;

(8) the major upsetting section and the secondary upsetting section of the first cavity having a volume sufficient to accommodate upset of all of the long stand of bar stock in the cavity by a single pass of the forging punch along the secondary cavity, the long stand of bar stock having a length to nominal cross-sectional width ratio of at least 8, the friction reducing material permitting the forging punch to move the long stand of bar stock along the secondary upsetting section while the long stand of bar stock is being upset in the major and secondary upsetting sections of the cavity.

BRIEF DESCRIPTION OF THE DRAWINGS

Preferred embodiments of the invention are shown in the drawings wherein:

FIG. 10 is a section through the rod end after the first pass showing the grain flow lines;

FIG. 11 is a section through the completed end connection showing the grain flow lines; and FIG. 12 is a section through the end connection of a sucker rod formed in several passes showing the grain flow lines.

DETAILED DESCRIPTION OF THE PREFERRED EMBODIMENTS

Figure 1:
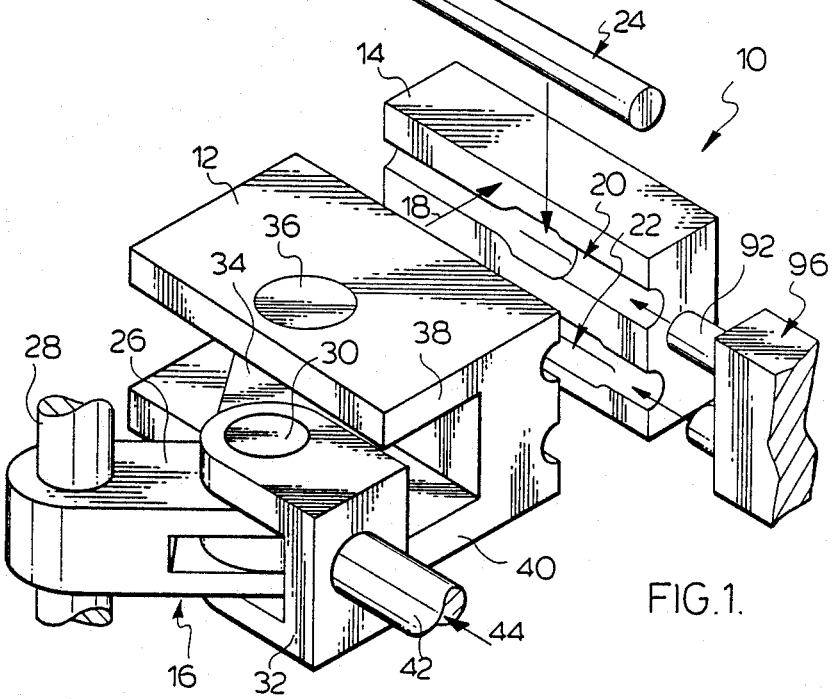
FIG. 1 is a perspective view of the heading die according to this invention for upsetting a long stand of malleable metal bar stock.

The heading tool for the forging apparatus is shown in FIG. 1. The hot upset forging machine has a frame (not shown) to which the gripper dies carrying the die cavities is connected and also to which the ram for the die punches is mounted. The forging apparatus 10 has opposing die blocks 12 and 14. Die block 14 is stationary and is mounted to the frame of the apparatus, whereas die block 12 is mounted on a toggle mechanism 16 for reciprocal movement in the direction of arrow 18 towards and away from the die block 14. The opposing die blocks have formed therein a first cavity 20 and a second cavity 22. The opposing die blocks have mirror images of the cavities such that when they mate they form the complete first and second die cavities within which the rod 24 is upset forged. The toggle mechanism 16, which provides for the reciprocal movement in the direction of arrow 18, includes a first link arm 26 which is secured to pivot axle 28 which, in turn, is connected to the frame of the apparatus. The other end of arm 26 is pivotally connected to pin 30 of U-shaped clevis 32. A second arm 34 has its first end pivoted to pin 30 and its second end pivoted to pin 36. The second pin 36 is securely mounted in the die block 12 between opposing ledge portions 38 and 40. In order to move the die block 12 towards die block 14, rod 42, which is secured to the clevis 32, is moved in the direction of arrow 44, whereby the toggle mechanism 16 pushes the die block 12 towards die block 14 to effectively grip the rod 24 when it is positioned in the respective cavity in a manner to be discussed with respect to FIGS. 6 through 9.

Figure 3:
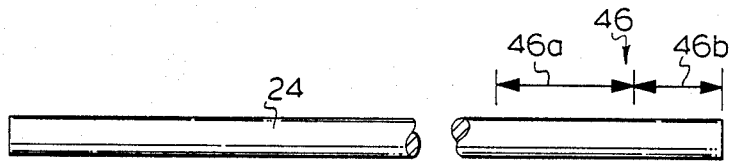
FIG. 3 is a side view of the bar stock of FIG. 2 showing the relative lengths of the intermediate and end sections which are heated to different forging temperatures.

To provide, in accordance with this invention, the upset forging of a long stand of the metal bar 24, the long stand is selectively heated to two different temperatures. As shown in FIG. 3, the bar 24 has a long stand portion 46 which consists of an intermediate section 46*a* and an end section 46*b*. The intermediate section 46*a* is heated to an upper forging temperature, whereas the end section 46*b* is heated to a lower forging temperature. It is appreciated that the temperature ranges for the upper and lower forging temperatures will vary considerably depending on the type of metal used. Should an acceptable grade of steel be chosen, such as, 0.40% carbon steel, the upper forging temperature may be in the range of 1090° C. to 1245° C. and the lower forging temperature may be in the range of 850° C. to 985° C. Preferred temperatures are approximately 1200°

C. for the upper forging temperature and approximately 980° C. for the lower forging temperature.

Figure 2:
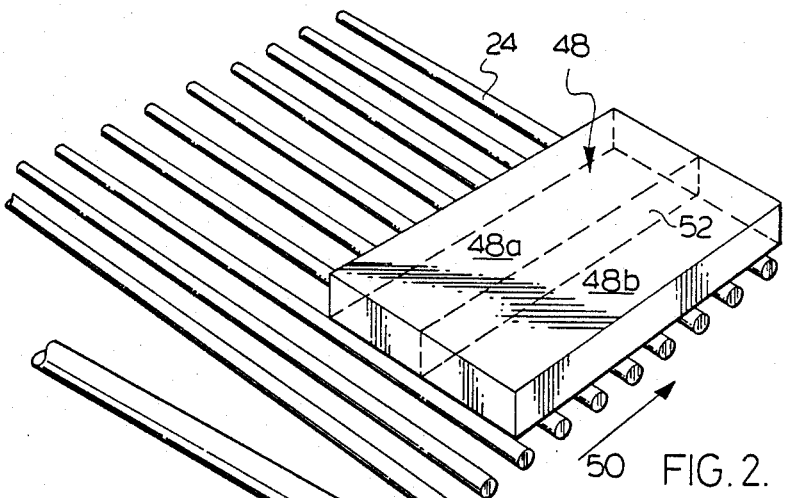
FIG. 2 is a perspective view of a representative type of heating device for selectively heating the end of the bar stock to be upset forged.

To accomplish this type of heating, a furnace 48 has two heating zones 48*a* and 48*b*. Heating zone 48*a* is at a sufficiently higher temperature than zone 48*b* to achieve the desired differentiation in temperatures of the intermediate section 46*a* and 46*b* to provide the selective heating of the long stand 46 for purposes of forging in the forging apparatus 10 of FIG. 1. It is appreciated that the furnace 48 may be gas fired, electric induction, or the like which will accomplish the desired heating of the long stand 46 to the desired temperatures for a predetermined residence time for the rods 24 traveling through the heating zone in the direction of arrow 50. As shown in FIG. 2, the heating zones 48*a* and 48*b* are divided by partition 52 to define heating widths corresponding to the length 46*a* of the intermediate section and length 46*b* of the end section of the long stand of the bar 24.

Figures 4A, 4B, 4C:
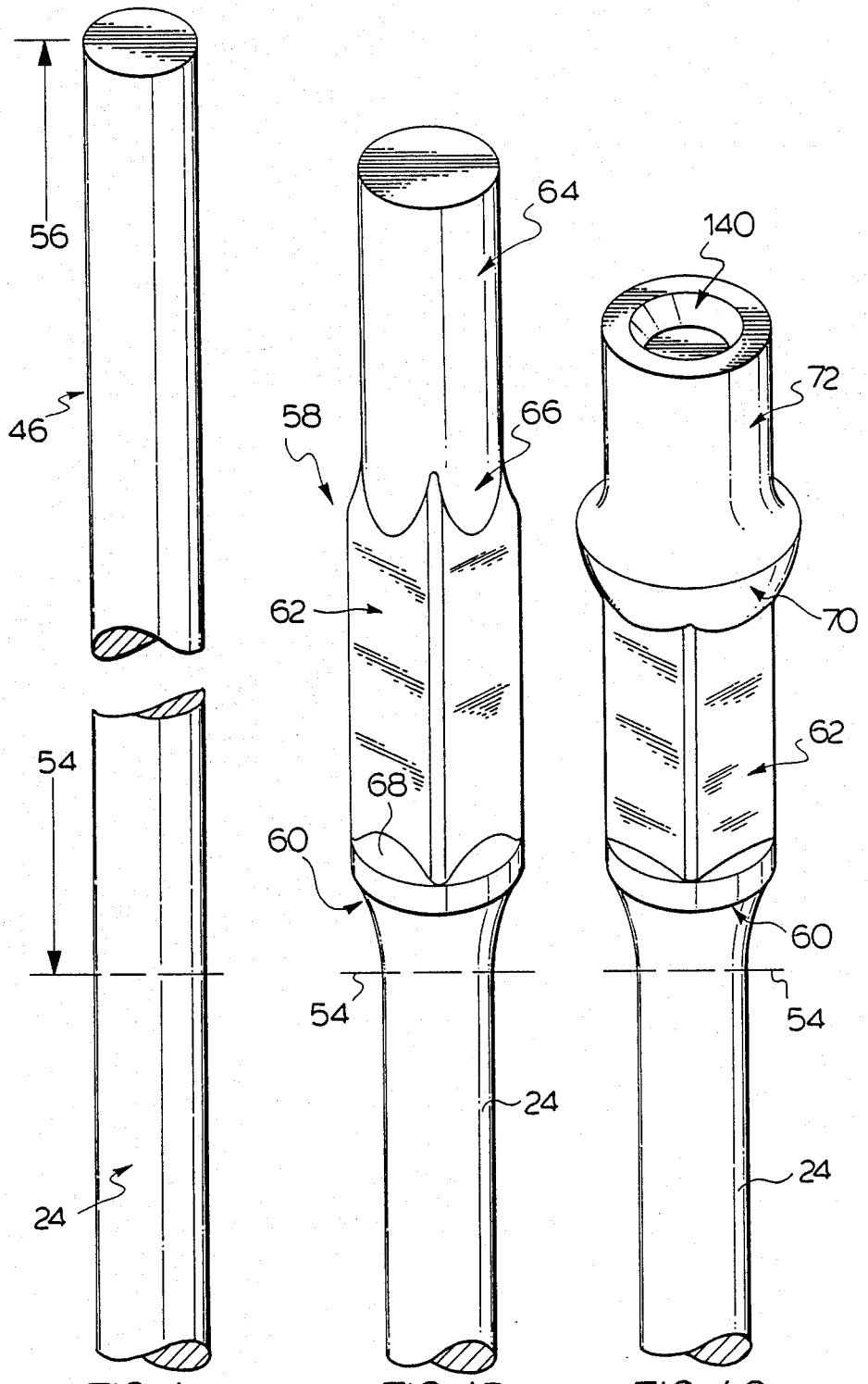
FIGS. 4*a, b* and *c* are perspective views of the rod having sequentially formed therein in two passes the end connection for the sucker rod.

In order to demonstrate the advantages of the process and apparatus according to this invention, reference will be made to the upset forging of the long stand of malleable metal bar stock in forging an end connection for a sucker rod. With reference to FIGS. 4*a* through 4*c*, the sequence of shapes in forming the end connection in two passes is shown. In FIG. 4*a*, the bar 24 has the long stand portion 46 extending between arrows 54 and 56 as selectively heated, is forged into the complex shape 58 as shown in FIG. 4*b*. From the reference point at 54, the long stand 46 is forged into the back shoulder 60 which is an enlarged rounded portion. Adjacent the back shoulder 60 is the multi-sided wrench flat portion 62. Adjacent the wrench flat is an enlarged cylindrical portion 64. A transition zone 66 is provided between the wrench flat 62 and the cylindrical portion 64. The back shoulder 60 includes a transition into the wrench flat 62 by way of the bulging lobes 68. Hence, from the long stand 46 the complex shape consisting of the back shoulder, the wrench flat and the cylindrical portion 64 is formed in a single pass in the manner to be discussed with respect to the subsequent figures. In the first pass, the ratio of the length of the stand between lines 54 and 56 to the diameter of the bar is usually in the range of 16.

In the second pass, the front shoulder 70 and the cylindrical tip 72 are formed. The cylindrical tip is subsequently threaded to complete the end connection. The front shoulder 70 and the cylindrical end portions 72 are upset forged from a portion of the wrench flat 62, the transition portion 66 and the cylindrical portion 64 in the manner to be discussed with respect to the second die cavity as shown in FIG. 5 and discussed with respect to FIGS. 8 and 9.

Figure 5:
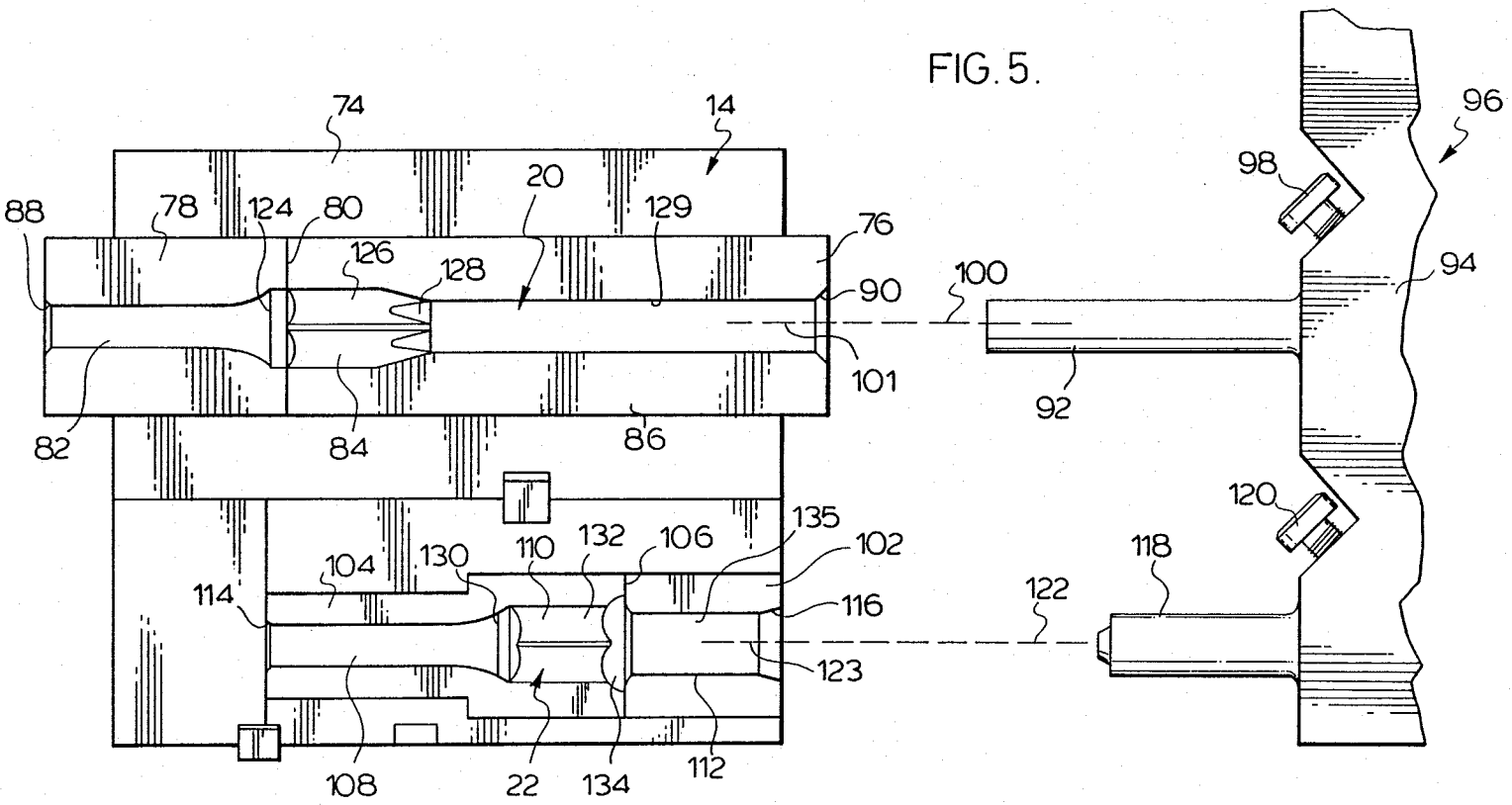
FIG. 5 is a side elevation of the forging apparatus according to this invention for upset forging on the end of a rod an end connection for a sucker rod.

Details of the die cavities are shown in FIG. 5 which form in two passes the end connection for the sucker rod as shown in FIG. 4*c*. The right half 14 of the opposing die blocks is shown with the first cavity section 20 positioned above the second cavity section 22. It is appreciated that, when the die blocks 12 and 14 are brought together by actuation of the toggle mechanism 16, the complete cavities are formed where the corresponding cavities in the die block 12 are mirror images of the cavities in the die block 14. The die block 14 has a body portion 74 which has secured therein the plate sections which define the respective halves of the first and second die cavities. The respective half of die cavity 20 is defined in plates 76 and 78. Plates 76 and 78 are secured to the die block body portion 74 by Allan screws or the like (not shown) to mount securely the plate portions in place. The plates are secured adjacent each other at the joint 80 with respective portions of the cavity 20 machined therein.

The one half section of cavity 20 includes a bar supporting section 82 which intimately contacts the bar stock. A major upsetting section 84 is adjacent the bar stock supporting section 82. Adjacent the major upsetting section is a secondary upsetting section 86. The bar supporting section 82 includes a lead-in portion 88 for the rod as it is positioned in the first die cavity 20. The secondary upsetting section also includes a lead-in portion 90 for the forging punch 92. The forging punch 92 is secured to the body portion 94 of the ram 96 which is also shown in FIG. 1. The punch 92 is removably mounted in the body portion 94. By placement of the punch in a bore within the body portion, a bolt 98 is threaded into the body portion to engage the punch 92 and secure it in position within the body portion 94. As the ram 96 is reciprocated relative to the die block 14, the punch 92 moves along an axis 100. The punch is arranged such that the axis 100 is coincident with the central axis 101 of the secondary upsetting section 86. Thus, the punch 92 is free to reciprocate within the secondary upsetting section 86. Both the major upsetting section and the secondary upsetting section are symmetrical about axis 101.

Similarly, half of the second die cavity 22 is secured to the body portion 74 of the die block 14. The half section of the second die cavity is defined within plates 102 and 104 which abut each other at joint 106. The cavity defined in the plates 102 and 104 consists of a bar supporting section 108 which merges into a major upsetting section 110. The major upsetting section 110 merges into a secondary upsetting section 112. The bar supporting section 108 includes a lead-in portion 114 for positioning of the upset forged bar, as removed from the first cavity. The secondary upsetting section 112 includes a lead-in portion 116 for the second punch 118 which is mounted in the body 94 of the ram 96. As with punch 92, the punch 118 is secured in the body 94 by way of threaded bolt 120. As the ram 96 reciprocates, the punch 118 moves along central axis 122. Axis 122 is coincident with the central axis 123 of the secondary upsetting section 112 of the die cavity. Hence, the punch 118 is free to move along the axis 122 of the secondary upsetting section 112.

The first die cavity in the major upsetting section includes a first wall portion 124 which defines the shape for the back shoulder 60 of the sucker rod shown in FIG. 4*b*. The wrench flat 62 of the sucker rod end connection is defined by faces 126 in the major upsetting section 84. The transition zone 66 is defined by cavity faces 128. The remaining cylindrical portion 129 of the upset forged sucker rod of FIG. 4*b* defines the bore 87 of the secondary upsetting section 86. In the second pass, the back shoulder 60 is located against wall section 130 of the second cavity. The wrench flats 62 are located against the wall section 132 of the major upsetting section 110 which is defined by intersecting faces of wall portion 132. The front shoulder is defined by wall section 134 of the major upsetting section of the cavity and the remaining cylindrical tip 72 is defined by wall section 135 of the secondary upsetting section 112.

Figure 6:
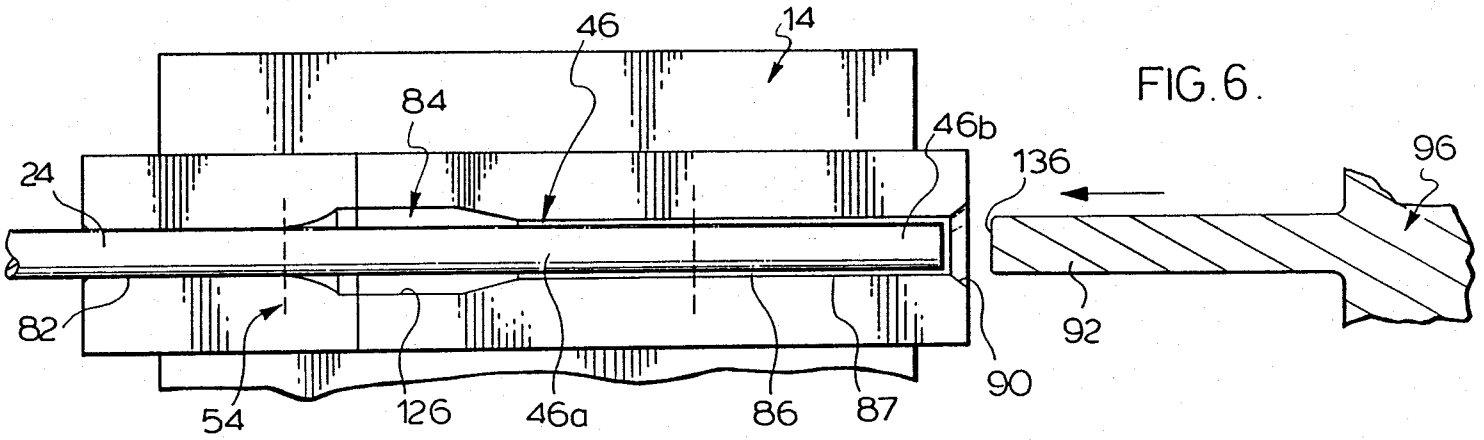
FIG. 6 is a section through the first die cavity of the forging apparatus of FIG. 5 showing the heated rod in position for upset forging.

With reference to FIG. 6, the long stand 46 of the bar stock is located in the cavity defined by clamped opposing mating sections of the die blocks 12 and 14. The rod 24 is positioned in the rod supporting section 82 with the reference line 54 of the long stand 46 located at the entrance to the major upsetting section 84. As shown with respect to FIG. 2 before positioning of the rod 24 in the first die cavity, the long stand is selectively heated to provide an intermediate section 46*a* at a forging temperature higher than the end section 46*b*. The majority of the intermediate section is located in the major upsetting section of the die cavity. The remaining minor length of the intermediate section 46*a* and all of the end section 46*b* lies in the secondary upsetting cavity 86. The punch 92 may either remain in the position shown, or the ram 96 advanced to locate the end 136 of the punch within the secondary upsetting section 86. With the punch positioned within section 86, end 136 may act as a stop to locate the base line 54 of the long stand 46 at the entrance to the major upsetting section 84 of the cavity. This arrangement assists in the manual operation of the forging apparatus. However, it is appreciated that in automation of the forging operation, a line may be scored on the rod 24 which can be picked up by an electronic eye to locate accurately the long stand 46 in the proper position in the major and secondary upsetting sections of the die cavity.

The forging apparatus is provided with a device for gripping the rod 24 to hold it stationary relative to the die cavity during the upset forging operation. This ensures that the reference line 54 remains approximately in the position shown in FIG. 6 adjacent the entrance to the major upsetting cavity 84. According to this particular embodiment, the bar supporting section 82 is sized such that when the die blocks are together, the cavity cross-sectional diameter is approximately equal to the nominal diameter of the bar 24. Hence when the toggle mechanism 16 closes the die blocks, the bar 24 is firmly gripped along the length of the bar supporting section 82 to hold the bar stationary during the forging operation.

Figure 7:
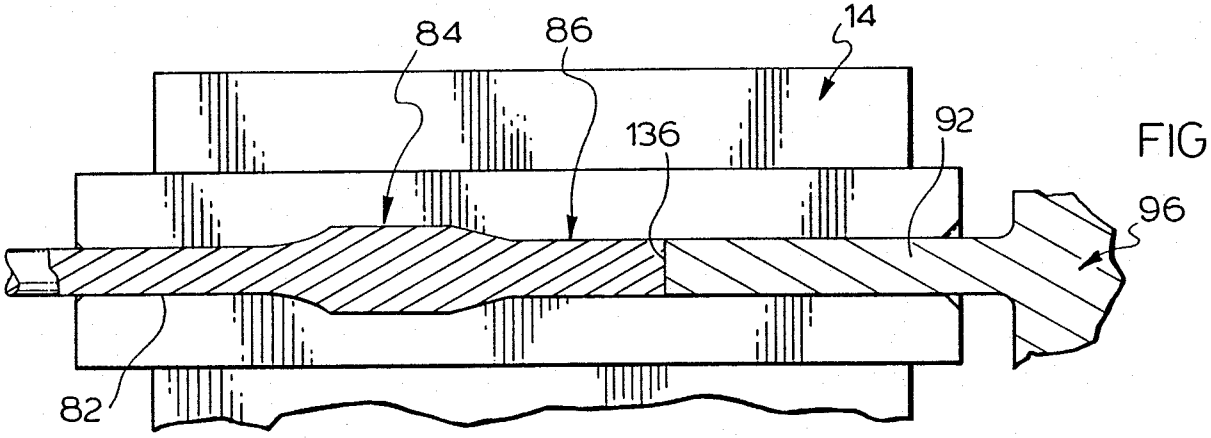
FIG. 7 is a section through the first cavity of FIG. 5 showing the position of the punch in having upset forged the rod section.

FIG. 7 shows the long stand 46 of the bar stock upset forged to fill the major upsetting section 84 and the remainder of a secondary upsetting section 86. The punch 92, in causing such upset, has moved the distance shown. Although FIG. 7 is not to scale, in this particular embodiment for upset forging a long stand of bar stock to form an end connection of a sucker rod in a single pass, the ratio of the length of the long stand bar stock to the cross-sectional diameter of the bar is approximately 16 to 18 depending upon the diameter of the stock. Normally sucker rod forgings involve rod diameters of 1.5 cm up to 3.5 cm which results in upsetting in a single pass bar stock length in the range of approximately 240 cm or more for smaller stock and approximately 570 cm or more for larger stock. This is a very significant volume of bar stock which is upset in one pass and is well outside of the generally accepted limits in upset forging the end of the bar using a heading tool forging apparatus. According to this invention, however, such significant volume of metal in the long stand may be upset forged because of the selective heating of the long stand to different forging temperatures and the use of a friction reducing material in the secondary upsetting cavity 86 which permits movement of long stand portion 46*b* along the cavity portion 86 during the upset forging operation. According to a preferred embodiment of the invention, the major upset cavity 84 may have a slight taper at least in the region of the wrench flat 62 defined by faces 126. The cavity of the major upset section 84 may increase slightly in cross-sectional dimension in moving along the flats 126 towards the portion 124 which defines the back shoulder 60. The taper may be of very slight, such as one-half of a degree slope relative to the axis 101 over the length of the wrench flats which is not sufficiently significant to show up on the views of FIGS. 6 and 7. In some circumstances, it may also be desirable to taper the secondary upset cavity 86. A similar taper may be provided in the circular shaped bore 87. The bore may increase in diameter in moving from the lead-in portion 90 towards the entrance of the major upset section 84. This taper may be approximately one-half of a degree slope relative to axis 101.

Various types of friction reducing material may be used in the bore 87 of the secondary upset cavity 86. It is appreciated that the walls of the cavity may be lined with a synthetic or metallic material which withstands the high forging temperatures, yet at the same time provides a degree of lubricity in reducing friction to allow movement of the lengthy portion 46*b* of the long stand along the secondary cavity as the metal is upset. According to a preferred embodiment of this invention, a lubricant may be applied to the cavity walls of the secondary section 86. The lubricant may be of the type which is used in high temperature forging normally for the purposes as a parting agent in allowing the metal to be freed from the die. Such high temperature lubricants usually include a mixture of graphite and grease and other components such as calcium fluoride. A commercially available type of lubricant is that sold under the trade mark FEL-PRO C-102 by Fel-Pro Incorporated of Skokee, Ill. The FEL-PRO lubricant may be applied to the cavity walls by way of a brush or the like during manual operation of the equipment. However, it is understood that with automation of the equipment, a spray device may be moved between the die cavity blocks 12 and 14 when they are open and direct a spray of the lubricant onto the cavity walls of the secondary upset chamber 86 of the first die cavity.

By way of selective heating of the long stand 46 to provide the intermediate section 46*a* at a forging temperature higher than the end portion 46*b*, control is exercised on the manner in which the long stand 46 is upset in the major and secondary upsetting sections of the die cavity. Due to portion 46*a* of the long stand being at a higher forging temperature, as the end 136 of the punch 92 commences to move the end portion 46*b* along the secondary section, the hotter intermediate section 46*a* commences to upset and fill the major upsetting section 84. However at the same time, portion 46*b* of the long stand also begins to upset and commence filling the secondary upsetting section 86. However due to the temperature differential, section 46*a* of the long stand continues to upset at a rate greater than portion 46*b* where portion 46*b* is the last to completely upset in filling of the remaining portion of the secondary upsetting section 86. The friction reducing material in the cavity portion 86 ensures that the portion 46*b* as it commences upsetting and engages the walls of cavity 86 continues to move along the secondary portion to ensure that all of section 46*a* is upset and fills major section 84 before complete upset of portion 46*b* to fill the remainder of secondary upsetting cavity section 86.

According to a preferred embodiment of the invention, the slight taper in the bore of the major and secondary cavity portions 84 and 86 assists in such movement of section 46*b* along the cavity portions by virtue of progressively filling the regions. In this manner according to the invention, significantly long stands of bar stock are then upset where the ratio of the length of the bar stock is in the range of 16 to 18 depending upon the bar stock diameter in forming end connections for sucker rods. It is appreciated, however, that the invention is equally applicable to smaller ratios such as 8 or greater. Upsetting volumes of metal at ratios less than 8 can also be accomplished by this invention; however, at the smaller ratios, selective heating of the end portion and friction reducing material is usually not required.

Figure 8:
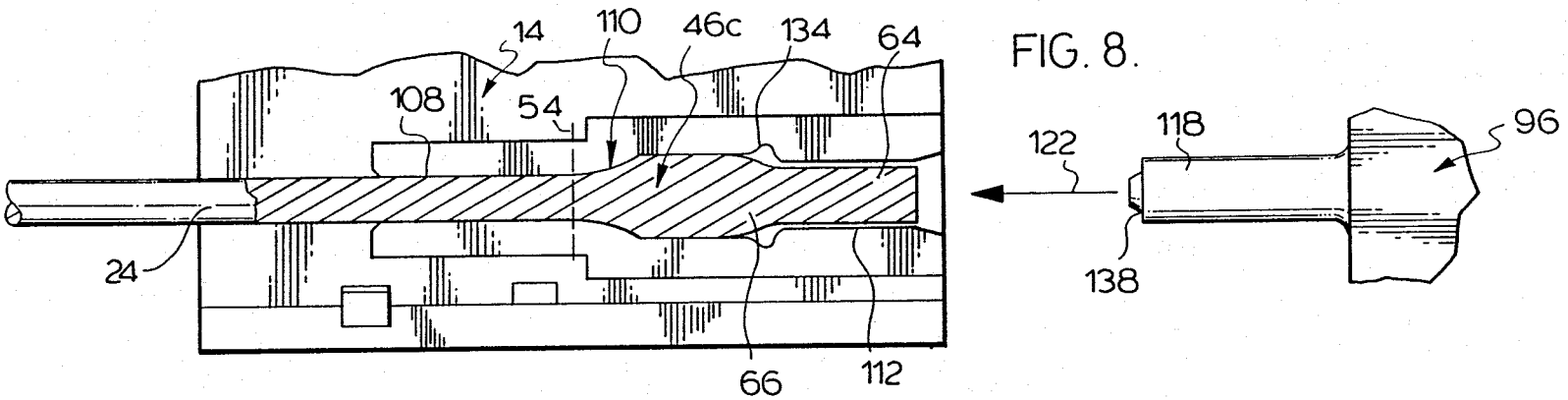
FIG. 8 shows the positioning of the upset rod in the second cavity in preparation for upset forging.
Figure 9:
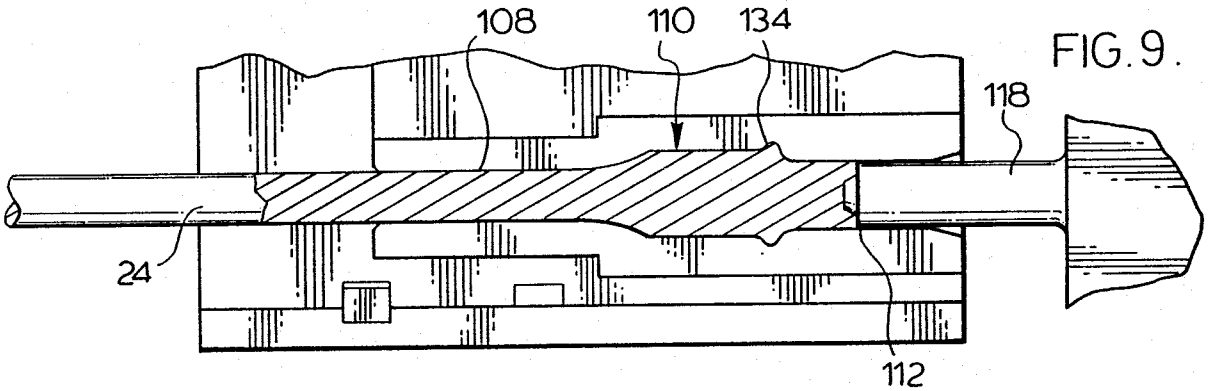
FIG. 9 is the same section as FIG. 8 showing the completion of the formation of the end connection in the sucker rod.

Upon completion of the single pass with the punch 92, as shown in FIG. 7, the ram 96 is withdrawn to remove the punch 92 either completely from the cavity 86 or to the stop position where the end 136 remains slightly within the cavity 86. The die blocks are then opened to permit removal of the rod end portion the rod upset forged by the single pass. The end portion resembles the shape shown in FIG. 4*b*. The end portion consists of a relatively complex shape consisting of a rounded shoulder 60, the flats 62 and the enlarged cylindrical end portion 64. For many applications in a single pass, a variety of complex shapes can be formed which could not be formed with existing technology. With the more complex shape for the end connection of a sucker rod, two passes are required. In the second pass, the front shoulder 70 and the cylindrical tip 72 are formed in the second die cavity 22. With reference to FIG. 8, the die block 14 has the upset long stand 46*c* positioned therein, where the reference line 54 is at the entrance to the major upsetting section 110. The bar 24 is positioned in the bar supporting section 108 which is of a diameter when the die blocks are closed to grip the bar stock 24 and hold the reference line at the entrance to the major upsetting section 110.

As described with respect to FIG. 5, the shoulder portion 130 of the major upset section 110 is essentially the same shape as the corresponding portion of the major upsetting section 84 of the first die cavity. Hence the back shoulder 60 and wrench flat 62 of the upset long stand 46*c* are snugly received by the cavity walls of this portion of the major upset section 110. The remainder of the major upset section 110 includes portion 134 which defines the front shoulder. As shown in FIG. 8 with the upset long stand 46*c* positioned in the section die cavity, there is a mating relationship between the back shoulder 60 and the wrench flat 62 in the cavity walls. However, the transition zone 66 and the cylindrical portion 64 are spaced from the cavity walls of portion 134 of the major upset section 110 and the secondary upset section 112. The second punch 118 moves along the axis 122 and has a specifically shaped end 138 which forms a recess portion 140 in the end of cylindrical tip 72 as shown in FIG. 4*c*.

With movement of the ram 96 in the direction of arrow 122 along its axis of the punch 118, the transition zone 66 and cylindrical portion 64 of the long stand 46*c* are upset forged into the remaining spaces of the major and secondary upsetting sections of the second cavity. It is appreciated that the mating relationship of the back shoulder and wrench flats may be used in locating the upset long stand 46*c* in the second cavity. However, to assist such location the ram 96 may position the end 138 of the punch 118 in the secondary cavity 112 at a position which locates the reference line 54 at the entrance to the major upsetting section 110. With the rod 24 gripped by the bar supporting section 108, movement of the punch 118 along the secondary cavity section 112 upsets the bar to completely fill the front shoulder portion 134 of the cavity and the remaining cylindrical portion of the secondary upsetting section 112. Compared to the length of travel in the first pass, the second pass in completing the shape for the sucker rod end connection is considerably less. Friction reducing materials are optional in the secondary upsetting portion of the cavity 112 as is selective heating of the cylindrical portion 64. If in the second pass, extreme upsetting is required, then selective heating and friction reducing materials may be used. In forging operations where the second pass follows immediately the first pass, reheating may not be required since the upset section 46*c* can be immediately withdrawn from the first cavity, positioned in the second cavity, the die blocks closed and the ram moved to upset the end section 64 in the transition section 66 of the long stand within a matter of seconds.

It is, of course, appreciated that in automation of this operation, movement of the upset long stand 46*c* from the first cavity to the second cavity can be accomplished in minimal time. However, there may be situations where reheating of section 46*c* is required due to time lags in positioning portion 46*c* of the long stand in the second cavity. For example, a factor which may affect reheat is the diameter of the bar stock and the rate at which the metal cools down in the environment. Should reheating be required, the cylindrical end 64 in the transition zone 66 would be heated to a desired forging temperature which would be in the range of approximately 1090° C. to 1245° C. Therefore, in accordance with this invention, by two passes in the forging apparatus, the complete configuration for the end connection of a sucker rod is forged. As discussed with respect to existing processes, such complex shape for the sucker rod end connection could only be formed in multiple passes usually five or six. In accordance with this invention, the long stand of metal is upset in a single pass to produce shape 46*c* which is then readily modified in the second pass to provide the remaining front shoulder and cylindrical tip. A significant advantage of the invention is that in forming the sucker rod end connection in two passes, symmetrical uniform grain flow lines are established in the end connection thereby avoiding any surface imperfections and discontinuity in the grain flow lines.

One of the significant problems with a multiple pass operation in forming an end connection for a sucker rod or other complex shapes is that the several passes begin to develop laps in the formed shoulders, where such laps produce disconformities in the grain flow pattern and nicks in the surface finish. Such nicks and notches in the surface finish considerably reduce the overall strength of the forged shape, because the notches act as stress points where failure in the metal can occur. With reference to FIGS. 10 through 12, comparisons of the grain flow lines in the end connections produced by this invention and that of an end connection produced by a five pass forging operation are shown.

In FIG. 10, a section through upset long stand portion 46*c* in which the back shoulder 60, the wrench flats 62 and the cylindrical end portion 64 have been formed. The grain flow lines 140, as schematically illustrated in FIG. 10, (yet truly representative of the grain flow lines in actual samples) shows a uniform symmetrical distribution in the regions of the back shoulder 60, the wrench flat area 62 and the cylindrical portion 64. This exemplifies the significant advantage in forming these regions in a single pass. The surfaces are uniform and continuous with no lapping apparent and resulting surprisingly smooth and symmetrical grain flow lines. In the second pass, as shown in FIG. 11, the formation of the front shoulder 70 and the remaining cylindrical tip 72 also produces grain flow lines 142 in these regions which are continuous and symmetrical without any surface imperfections due to lapping. By the mating fit of the back shoulder 60 and the wrench flat 62 in the second die cavity, no lapping in these regions has occurred.

As exemplified in FIG. 12, a sucker rod end connection developed by a five pass forging technique produces several discontinuities 144 in the grain flow lines 146. Such discontinuities occur in the back shoulder 148 and in the front shoulder 150. With sucker rod end connection manufacture, such discontinuities and notches in the surface develop stress points which significantly weaken the connection and results in significantly reduced lifespans in the field. Techniques have been developed at forging plants to remove such notches developed by laps in the forging operation to remove such stress points in the connection. However, an operator can spend as much time removing the surface imperfections as is spent in forming the sucker end connection. As a result, by existing five pass operations, the imperfections in the surface add considerably to the overall cost of manufacture due to the labor intensive inspection of each end connection and time required to modify the end connection in removing the imperfections.

It is appreciated that the die cavities may be formed from various grades of high alloy steels commonly used in die cavity manufacture. The high speed steels are commonly used which have sufficient hardness to resist abrasion and the effects of heat used in the forging operation. The die cavity design is such to resemble standard types of existing forms of gripper dies, such as already used in five pass and six pass forging of sucker rod end connections, the only difference being in the design for the first and second die cavities of this invention.

Although preferred embodiments of the invention have been described herein in detail, it will be understood by those skilled in the art that variations may be made thereto without departing from the spirit of the invention or the scope of the appended claims.

I claim:

1. A process for upset forging a long stand of solid malleable metal bar stock in a single pass to gather a large volume of the bar stock into a complex shaped element, said process comprising:

(1) selectively applying heat to said long stand of bar stock by heating an intermediate section thereof to desired upper forging temperature and heating an end section thereof to desired lower forging temperature;

(2) positioning said selectively heated long stand of bar stock in an upset forging die cavity comprising opposing mating die blocks within which said cavity is defined, said cavity having:

(a) a bar supporting section which intimately contacts said bar stock inwardly of said heated intermediate section in a direction away from said end section;

(b) a major upsetting section surrounding a major length of said heated intermediate section, and (c) a secondary upsetting section surrounding a remaining minor length of said intermediate section and said end section, said secondary upsetting section receiving and guiding a forging punch and having a cavity configuration different than a cavity configuration of said major upsetting section;

(3) said secondary upsetting section being provided with a high temperature lubricant capable of withstanding forging temperatures for reducing friction on cavity walls thereof;

(4) gripping said bar stock inwardly of said intermediate section to hold said gripped bar stock stationary relative to said die blocks in preparation for upset forging of said intermediate and said end sections of said bar stock;

(5) punching with said forging punch in a single blow said end section to upset said intermediate section to fill said major upsetting section of said cavity, said lower forging temperature of said end section being such that a controlled upset of said end section in said secondary upsetting cavity section having said friction reducing material provides for sliding of said end section along said secondary upsetting cavity section while said end section upsets and gathers said intermediate section in said major upsetting cavity section;

(6) continuing travel of said single punch blow to complete filling said secondary upsetting cavity section with said end portion.

2. A process of claim 1, wherein said long stand of bar stock has a length to nominal cross-sectional width ratio of at least 8.

3. A process of claim 2, wherein said intermediate section of said long stand is approximately twice the length of said end section of said long stand.

4. A process of claim 2, wherein said bar stock is formed of stainless steel, carbon steel or low alloy steel.

5. A process of claim 2, wherein said bar stock is formed of a carbon steel, said intermediate section being heated to a forging temperature in the range of 1090° C. to 1245° C. and said end section being heated to a forging temperature in the range of 850° C. to 985° C.

6. A process of claim 2, wherein said long stand of bar stock is circular in cross-section.

7. A process of claim 2, wherein said long stand of bar stock is circular in cross-section and has a diameter ranging from 1.5 cm up to 3.5 cm.

8. A process of claim 1, wherein said secondary upsetting section is tapered slightly in a direction away from said major upsetting section.

9. A process of claim 1, wherein in a single blow of said forging punch, said long stand is forged into said complex shape having an enlarged rounded portion, an adjacent enlarged multi-sided portion and an adjacent enlarged cylindrical portion.

10. A process of claim 9, wherein said long stand of bar stock is formed of carbon steel, said single blow of said forging punch in forming said complex shape developing a symmetrical array of metal grain flow lines in transition from one of said portions to the next of said complex shape.

11. A process of claim 1, wherein said secondary upsetting section of said cavity is an elongate bore circular in cross-section and slightly tapered in a direction away from said major upsetting cavity.

12. A process for upset forming a long stand of solid malleable metal bar stock in a single pass to gather a large volume of the bar stock into a complex shaped element, said process comprising:

(1) selectively applying heat to said long stand of bar stock by heating an intermediate section thereof to desired upper forging temperature and heating an end section thereof to desired lower forging temperature; of (2) positioning said selectively heated long stand bar stock in an upset forging die cavity comprising opposing mating die blocks within which said cavity is defined, said cavity having:

(a) a bar supporting section which intimately contacts said bar stock inwardly of said heated intermediate section in a direction away from said end section;

(b) a major upsetting section surrounding a major length of said heated intermediate section, and (c) a secondary upsetting section surrounding a remaining minor length of said intermediate section and said end section, said secondary upsetting section receiving and guiding a forging punch and having a cavity configuration different than a cavity configuration of said major upsetting section;

(3) said secondary upsetting section being provided with a lubricant for reducing friction on cavity walls thereof;

(4) gripping said bar stock inwardly of said intermediate section to hold said gripper bar stock stationary relative to said die blocks in preparation for upset forging of said intermediate and said end sections of said bar stock;

(5) punching with said forging punch in a single blow said end section to upset said intermediate section to fill said major upsetting section of said cavity, said lower forging temperature of said end section being such that a controlled upset of said end section in said secondary upsetting cavity section having said friction reducing material provides for sliding of said end section along said secondary upsetting cavity section while said end section upsets and gathers said intermediate section in said major upsetting cavity section;

(6) continuing travel of said single punch blow to complete filling said secondary upsetting cavity section with said end portion, wherein in a single blow of said forging punch, said long stand is forged into said complex shape having an enlarged rounded portion, an adjacent enlarged multi-sided portion and an adjacent enlarged cylindrical portion, wherein said long stand of bar stock is formed of carbon steel, said single blow of said forging punch in forming said complex shape developing a symmetrically array of metal grain flow lines in transition from one of said portions to the next of said complex shape, and wherein said process is for forging a sucker rod end, said sucker rod having forged therein a back shoulder, a wrench flat which is rectangular in cross-section, a front shoulder and a cylindrical tip, in said single blow of said forging punch said enlarged rounded portion forming said back shoulder and said multi-faced portion forming said wrench flat.

13. A process of claim 12, wherein said remaining cylindrical portion is reheated to a forging temperature in the range of 1090° C. to 1245° C. before said second forging operation.

14. A process for upset forging a long stand of steel bar stock in two passes into an end connection for a sucker rod, the end connection consisting of a back shoulder, a wrench flat, a front shoulder and a cylindrical tip which is subsequently threaded, said process comprising for said first pass:

(1) selectively applying heat to said long stand of bar stock by heating an intermediate section thereof to desired upper forging temperature and heating an end section thereof to desired lower forging temperature;

(2) positioning said selectively heated long stand of bar stock in an upset forging first die cavity comprising opposing mating die blocks within which said first cavity is defined, said first cavity having:

(a) a bar supporting section which intimately contacts said bar stock inwardly of said heated intermediate section in a direction away from said end section;

(b) a major upsetting section surrounding a major length of said heated intermediate section, and (c) a secondary upsetting section surrounding a remaining minor length of said intermediate section and said end section, said major upsetting section defining said back shoulder and said wrench flat portions of said end connection and said secondary upsetting section defining an enlarged cylindrical portion which is forged into said front shoulder and cylindrical tip in said second pass, said secondary upsetting section receiving and guiding a forging punch and having a cavity configuration different than a cavity configuration of said major upsetting section;

(3) said secondary upsetting section being provided with means for reducing friction on cavity walls thereof;

(4) gripping said bar stock inwardly of said intermediate section to hold said gripped bar stock stationary relative to said die blocks in preparation for upset forging of said intermediate and said end sections of said bar stock;

(5) punching with said forging punch in a single pass said end section to upset said intermediate section to fill said major upsetting section of said cavity, said lower forging temperature of said end section being such that a controlled upset of said end section in said secondary upsetting cavity section having said friction reducing material provides for sliding of said end section along said secondary upsetting cavity section while said end section upsets and gathers said intermediate section in said major upsetting cavity section;

(6) continuing travel of said single punch blow to complete filling said secondary upsetting cavity section with said end portion;

(7) removing said long stand of steel bar as forged from said first die cavity and positioning said forged steel bar in an upset forging second die cavity comprising opposing mating die blocks within which said second cavity is defined, said second cavity having:

(a) a bar supporting section which intimately contacts said bar stock inwardly of said back shoulder;

(b) a back shoulder and wrench flat supporting section which receives and supports said back shoulder and a portion of said wrench flat;

(c) a major upsetting section surrounding a remaining portion of said wrench flat and a transition portion of said long stand from said wrench flat into said cylindrical portion and a portion of said cylindrical portion;

(d) a secondary upsetting section surrounding a remaining portion of said cylindrical portion;

said major upsetting section of said second cavity defining said front shoulder and said secondary upsetting section defining said cylindrical tip, said secondary upsetting section of said second cavity receiving and guiding a second forging punch;

(8) gripping said bar stock inwardly of said back shoulder to hold said gripped bar stock stationary relative to said die blocks defining said second cavity;

(9) punching with said second forging punch in a second pass said cylindrical portion to upset at least said transition zone and a portion of said cylindrical portion to fill said major upsetting section of said second cavity to upset forge said front shoulder and upsetting a remaining portion of said cylindrical portion to fill said secondary upsetting section of said second cavity to upset forge said cylindrical tip.

15. A process of claim 14, wherein said bar stock is formed of a carbon steel, said intermediate section being heated to a forging temperature in the range of 1090° C. to 1245° C. and said end section being heated to a forging temperature in the range of 850° C. to 985° C.

16. A process of claim 14, wherein said transition portion and cylindrical portion are reheated to a forging temperature in the range of 1090° C. to 1245° C. before said second pass.

17. A process of claim 14, wherein said means for reducing friction is a high temperature lubricant capable of withstanding forging temperatures which is applied to said secondary upsetting section of said cavity.

18. A process of claim 14, wherein said secondary upsetting section of the first die cavity is tapered slightly in a direction away from said major upsetting section.

19. A process for upset forging a long stand of solid malleable metal bar stock of carbon steel in a single pass to gather a large volume of the bar stock into a complex shaped element which is part of a sucker rod end having a back shoulder and a wrench flat which is rectangular in cross-section, said process comprising:

(1) selectively applying heat to said long stand of bar stock by heating an intermediate section thereof to desired upper forging temperature and heating an end section thereof to desired lower forging temperature;

(2) positioning said selectively heated long stand of bar stock in an upset forging die cavity comprising opposing mating die blocks within which said cavity is defined, said cavity having:

(a) a bar supporting section which intimately contacts said bar stock inwardly of said heated intermediate section in a direction away from said end section;

(b) a major upsetting section surrounding a major length of said heated intermediate section, and (c) a secondary upsetting section surrounding a remaining minor length of said intermediate section and said end section, said secondary upsetting section receiving and guiding a forging punch and having a cavity configuration different than a cavity configuration of said major upsetting portion;

(3) said second upsetting a section being provided with a lubricant for reducing friction on cavity walls thereof;

(4) gripping said bar stock inwardly of said intermediate section to hold said gripped bar stock stationary relative to said die blocks in preparation for upset forging of said intermediate and said end sections of said bar stock;

(5) punching with said forging punch in a single blow said end section to upset said intermediate section to fill said major upsetting section of said cavity which shapes said intermediate section into a complex shape having an enlarged rounded portion which forms said back shoulder and an adjacent enlarged multi-sided portion which forms said wrench flat, said single blow of forging punch developing a symmetrical array of metal grain flow lines in transition from one of said portions to the next of said complex shape, said lower forging temperature of said end section being such that a controlled upset of said end section in said secondary upsetting cavity section having said friction reducing material provides sliding of said end section along said secondary upsetting cavity section while said end section upsets and gathers said intermediate section in said major upsetting cavity section;

(6) continuing travel of said single punch blow to complete filling said secondary upsetting cavity section with said end portion.

20. A process of claim 19 wherein said remaining cylindrical portion is reheated to a forging temperature in the range of 1090° C. to 1245° C. before said second forging operation.

* * * * *